United States Patent [19]

Baldino

[11] Patent Number: 4,984,401

[45] Date of Patent: Jan. 15, 1991

[54] DEVICE AND METHOD FOR HOUSING A STEEL REINFORCEMENT IN AN AREA WHERE JOINTS ARE MADE BETWEEN FIRST AND SUBSEQUENTLY POURED CONCRETE STRUCTURES

[75] Inventor: Michael Baldino, Omaha, Nebr.

[73] Assignee: Dayton Superior Corporation, Miamisburg, Ohio

[21] Appl. No.: 387,684

[22] Filed: Jul. 31, 1989

[51] Int. Cl.[5] ..... E04G 15/04

[52] U.S. Cl. ..... 52/378; 52/699; 52/741

[58] Field of Search ..... 52/576, 577, 713, 712, 52/699, 698, 378, 741; 249/188

[56] References Cited

U.S. PATENT DOCUMENTS

| | | | |
|---|---|---|---|
| 3,328,932 | 7/1967 | Cheskin | 52/577 |
| 3,834,103 | 9/1974 | Knohl | 52/698 |
| 4,010,586 | 3/1977 | Brechbuhler | 52/309.16 |
| 4,325,533 | 4/1982 | Tiletschke et al. | 249/188 |
| 4,329,825 | 5/1982 | Zehtner | 52/713 |
| 4,388,757 | 7/1982 | Witschi et al. | 52/699 |
| 4,419,852 | 12/1983 | Dietrich | 52/309.16 |
| 4,468,907 | 9/1984 | Tiletschke | 52/378 |
| 4,549,384 | 10/1985 | Brechbuhler | 52/704 |
| 4,562,679 | 1/1986 | Pattiselanno | 52/378 |
| 4,685,267 | 8/1987 | Workman | 52/576 |
| 4,742,655 | 5/1988 | Kovasna | 52/98 |
| 4,796,851 | 1/1989 | Brechbuehler | 249/91 |

FOREIGN PATENT DOCUMENTS

| | | | |
|---|---|---|---|
| 1684196 | 4/1971 | Fed. Rep. of Germany | 52/699 |
| 3127087 | 1/1983 | Fed. Rep. of Germany . | |

OTHER PUBLICATIONS

Stabox Bulletin No. 86–2, Rebar Connection System, by Rebar Coupler Box, Inc. Recostal, by Contec Bausysteme gmbh.

*Primary Examiner*—John E. Murtagh

*Attorney, Agent, or Firm*—Panitch Schwarze Jacobs & Nadel

[57] ABSTRACT

A protective device for a housing steel reinforcement in an area where joints are made between first and subsequently poured concrete structures. The device includes a sheet of material having a first end portion and an opposed second end portion. The sheet of material is folded such that the first end portion and the second end portion are in an overlapping facing relationship to form a housing of generally rectangular cross section. Adhesive tape is wrapped around a portion of the generally tubular housing to hold the sheet of material in the folded position. The adhesive tape allows quick access to the interior of the housing by cutting the tape and unfolding the sheet of material. A plurality of steel reinforcement bars are provided having a first portion positioned within the housing for being imbedded in the subsequently poured concrete structure and second portion extending out of the housing through an aperture in the housing for being imbedded in the first poured concrete structure.

11 Claims, 2 Drawing Sheets

DEVICE AND METHOD FOR HOUSING A STEEL REINFORCEMENT IN AN AREA WHERE JOINTS ARE MADE BETWEEN FIRST AND SUBSEQUENTLY POURED CONCRETE STRUCTURES

FIELD OF THE INVENTION

The present invention relates to forming concrete structures and, more particularly, to a device and method for housing steel reinforcements in areas where joints are made between first and subsequently poured concrete structures.

BACKGROUND OF THE INVENTION

Concrete walls are typically constructed with large size planking or formwork. Using large size formwork is problematic in that the main load carrying wall must be recessed or include a keyway for the connection of partition or interior walls, stairs and intermediate floors. Conventionally, in order to bond a partition wall or staircase to a concrete structure, a connection groove was chiseled by hand using hammers. Such work is difficult, time consuming and expensive.

At first, this problem was avoided by encasing linear steel reinforcement bars in a strip of polystyrene plastic. The polystyrene plastic casing is secured to inside of the formwork with the bars extending through corresponding holes in the formwork wall. After the concrete solidifies, the formwork is removed over the bars and the polystyrene plastic is chipped away to create a keyway. This method is problematic because the formwork would generally be limited to a single use and the extensive amount of time required to remove the polystyrene plastic.

A solution to this problem, entailed bending the bars at a right angle and placing them in a hollow protective device secured to the formwork wall with a portion of the bar extending into the formwork area and another portion positioned within the hollow protective device. Thus, a connection groove is formed when the concrete is poured and the reinforcing steel rods are already concreted into the main wall. Therefore, the steel rods merely had to be bent to horizontal before the second wall was poured.

The present invention is directed to a device for housing steel reinforcements in areas where joints are made between first and subsequently poured concrete structures. Specifically, the devices of a type according to this invention are used in concrete construction to produce wall-to-wall or wall-to-slab junctions. They produce a continuous steel reinforcement in the joint region of two concrete structures with a T-shaped cross section.

Devices for protecting the steel reinforcements during the pouring of the first concrete structure are known. In the last few years, the use of industrially manufactured reinforcing rod holders which have already been equipped with the reinforcing rods before leaving the factory has increased considerably, and a large number of extremely varied reinforcing rod holders have been designed and used. During the course of ever wider applications and ever greater attempts at efficiency, it has become important to rapidly remove the protective portion of the rod holders to facilitate connection of the second wall.

It has also become important to safely remove the protective portion of the rod holders. Conventional protective devices are formed of sheet metal or expanded metal which, when being removed, often cuts or injures the remover. This has given rise to an increase in workman's compensation claims.

Attempts have been made to solve this problem by constructing the protective portion with a vacuum formed thin polymeric material. However, the thin protective portion tends to collapse when the concrete is poured, thereby distorting the keyway. Therefore, the keyway has to be hand chiseled to its proper shape. Additionally, the protective portions formed from polymeric materials often break during removal and, therefore, involve additional work to remove. Since the vacuum formed protective portions are derived from a mold, the position of the holes for receiving the reinforcement bars is predetermined and inflexible. Thus, the spacing of the reinforcement bars cannot be modified at the job site.

The present invention overcomes many of the disadvantages inherent in the above-described protective devices by providing a protective device which can be rapidly and safely removed from the main wall after it has solidified. Moreover, the protective device of the present invention is versatile in that the bars can be positioned within the device in any arrangement or spacing. Consequently, the protective device of the present invention increases job site safety and saves considerable time and money at the job site by reducing the time necessary to build concrete structures.

SUMMARY OF THE INVENTION

Briefly stated, the present invention comprises a device for housing a steel reinforcement in an area where joints are made between first and subsequently poured concrete structures. The device includes a sheet of material having a first end portion and an opposed second end portion. The sheet of material is folded such that the first end portion and the second end portion are in engagement to thereby form a housing of generally tubular cross section. Securing means are provided for holding the sheet of material in the folded position. At least one steel reinforcement bar is provided having a first portion thereof positioned within the housing for being imbedded in the subsequently poured concrete structure and a second portion thereof extending through an aperture in the housing for being embedded in the first poured concrete structure.

BRIEF DESCRIPTION OF THE DRAWINGS

The foregoing summary, as well as the detailed description of the preferred embodiments, are better understood when read in conjunction with the appended drawings. For the purpose of illustrating the invention, there is shown in the drawings embodiments which are presently preferred, it being understood, however, that the invention is not limited to the specific methods and instrumentalities disclosed. In the drawings.

DESCRIPTION OF THE PREFERRED EMBODIMENTS

Figure 1:
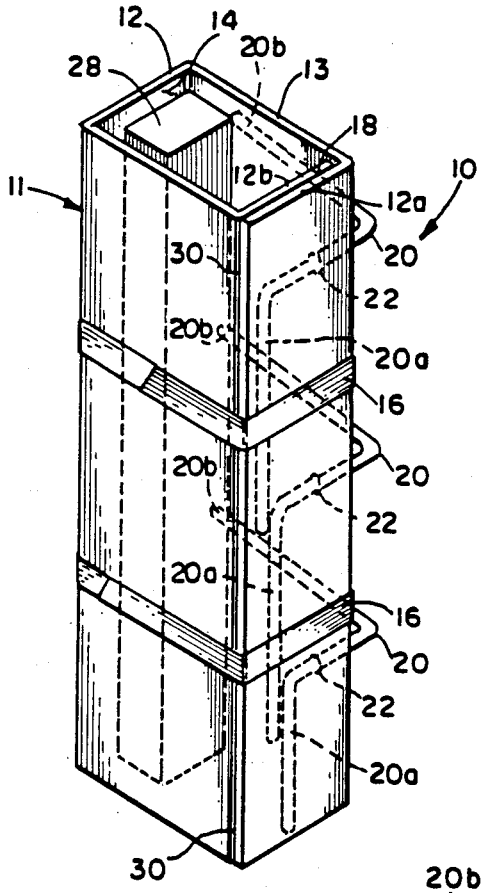
FIG. 1 is a perspective view of a device for housing steel reinforcements in accordance with a first preferred embodiment of the invention.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the device for housing steel reinforcement bars and designated parts thereof. The terminology includes the words above specifically mentioned, derivatives thereof and words of similar import.

Figure 2:
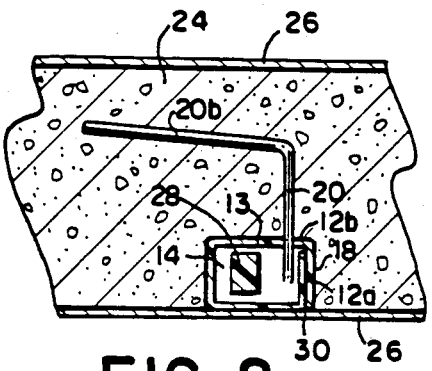
FIG. 2 is a cross-sectional view of the device of FIG. 1 positioned within a first poured concrete structure.
Figure 3:
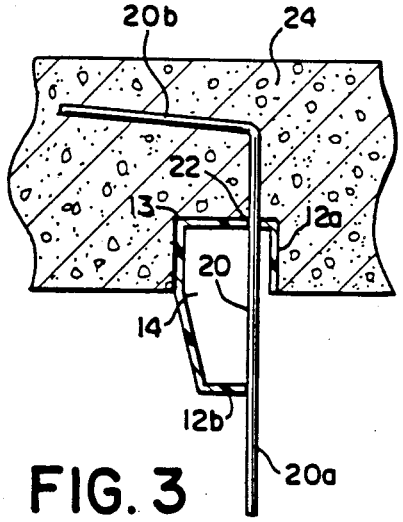
FIG. 3 is a cross-sectional view of the device of FIG. 1 in the open position for bending the steel reinforcement bars to horizontal.

Referring to the drawings in detail wherein like numerals indicate like elements throughout there is shown in FIGS. 1–3 a first preferred embodiment of a device for housing steel reinforcements in areas where joints are made between first and subsequently poured concrete structures in accordance with the present invention, shown in both assembled and open forms. FIG. 1 perspectively illustrates the protective device, generally designated 10.

Referring now to FIGS. 1 and 2, the protective device 10 comprises a sheet of material 12 having a first end portion 12*a* and an opposed second end portion 12*b*. As shown in FIG. 2, the sheet of material 12 is folded such that the first end portion 12*a* and the second end portion 12*b* are in engagement to thereby form a housing 11 of generally tubular cross-section. In the first preferred embodiment, it is preferred that the first end portion 12*a* and the second end portion 12*b* be in an overlapping relationship to provide a good seal for preventing liquefied concrete from entering the interior 14 of the housing 11.

In the first preferred embodiment, the sheet of material 12 is preferably folded in the form of a housing 11 of generally rectangular cross-section, as shown in FIG. 1. However, it is understood by those skilled in the art, that the sheet of material 12 could be folded to form any suitable geometric cross section, such as square or trapezoid, so long as the sheet of material 12 maintains its generally tubular form.

In the first preferred embodiment, the sheet of material 12 is preferably corrugated to provide the protective device 10 with sufficient strength to prevent it from collapsing due to the weight of the concrete, without increasing the weight of the productive device 10 for maintaining shipping costs at a minimum. More particularly, it is preferred that the sheet of material 12 be constructed of a polymeric material with a resin matrix, such as polypropylene or polyvinylchloride, which is corrugated to a thickness of approximately 5.0 mm., to also limit the weight of the protective device 10.

However, it is understood by those skilled in the art, that the sheet of material 12 can be constructed of any suitable material which is readily foldable and will generally maintain its folded configuration. More particularly, it is preferred that the sheet of material be rebendable, easy to strip or tear and will not bond to concrete. Similarly, it is understood by those skilled in the art that the sheet of material 12 can be solid instead of corrugated without departing from the spirit and scope of the invention. By constructing the sheet of material 12 of a corrugated polymeric material without sharp edges, it is readily folded for allowing ease of assembly and is safe to work with to prevent injuries.

As shown in FIG. 1, securing means are provided for holding the sheet of material 12 in the folded position. In the first preferred embodiment, the securing means preferably comprises strips of plastic tape 16 having an adhesive backing on one side thereof wrapped around the generally tubular housing 11. As used herein, "adhesive tape" refers to tape of any material having an adhesive backing on one side thereof. By cutting the tape 16 at the seam 30 and unfolding the sheet of material 12, the interior 14 of the housing 11 is quickly accessed, as shown in FIG. 3. However, it will be appreciated by those skilled in the art that other means may be used for maintaining the sheet of material 12 in the folded position, such as an adhesive or hook and loop material positioned at the interface 18 of the first end portion 12*a* and the second end portion 12*b* (not shown) or a U-shaped staple (not shown) inserted across the seam 30 of the end portions.

Preferably, the adhesive tape 16 has a width of approximately 4.5 cms. to provide wide gripping action across the seam 30 of the housing 11. However, it is understood that the adhesive tape 16 can be of any suitable width, without departing from the spirit and scope of the invention. In the first preferred embodiment, the adhesive tape 16 is preferably spaced along the length of the housing 11 at approximately one foot intervals to firmly secure the housing 11 in the folded position, without requiring excessive cutting steps to unfold the housing 11, as described hereinafter. However, it is understood by those skilled in the art that the adhesive tape 16 can be interspersed along the length of the housing 11 at any suitable interval, such as two feet, depending upon the width of the first poured concrete wall.

As shown in FIG. 1, the protective device 10 includes a plurality of steel reinforcement bars 20. The steel reinforcement bars 20 have a first portion 20*a* positioned within the housing for being imbedded in the subsequently poured concrete structure (not shown). The steel reinforcement bars 20 also include a second portion 20*b* extending out of the housing 11 through an aperture 22 in the housing 11 for being imbedded in the first concrete structure 24. As shown in FIG. 1, the steel reinforcement bars 20 are positioned within the housing 11 with the first portion 20*a* at a right angle to the second portion 20*b*, for allowing the protective device 10 to be positioned within a concrete formwork 26 (see FIG. 2).

Preferably, the steel reinforcement bars 20 are constructed having physical and chemical properties which allow the bars 20 to be bent to a horizontal position after the first poured concrete structure 24 solidifies without fatiguing or sacrificing the strength of the bar 20, as is understood by those skilled in the art. In the first preferred embodiment, the steel reinforcement bars 20 can be positioned anywhere along the length of the housing 11.

To assemble the protective device 10, the sheet of material 12 is folded to form creases at the fold lines. The bars 20 are positioned within the housing 11 by using the end of the second portion 20*b* to puncture the aperture 22 anywhere along the back portion 13 of the sheet of material 12. Thus, the bars 20 can be selectively positioned within the housing 11 either symmetrically or asymmetrically. Therefore, the protective device 10 can meet a variety of needs at the construction site. After the bars 20 are positioned, the sheet of material 12 is folded with the first and second end portions 12*a*, 12*b* in engagement and the adhesive tape 16 is applied to hold the sheet of material 12 in the folded position.

Referring now to FIG. 2, in the first preferred embodiment, the protective device 10 includes a stiffener 28 positioned within the housing 11 for increasing the rigidity of the housing 11. It is understood by those skilled in the art, that the stiffener 28 is not required for the present invention to function, but is merely used to add further strength to the protective device 10 when needed. For instance, when the first poured concrete structure 24 is of relatively large width and weight, the stiffener 28 may be included in the housing 11. Consequently, the stiffener 28 can be omitted from the protective device 10 without departing from the scope and spirit of the invention.

In the first preferred embodiment, the stiffener 28 is constructed of high strength plastic material, such as polyurethane. However, it is understood by those skilled in the art that the stiffener 28 can be constructed of any high strength polymeric material, such as polystyrene. Additionally, the stiffener could be constructed of cellulose pulp having a honeycomb design for added strength. Moreover, it is preferred that the stiffener 28 be a length generally equal to that of the length of the housing 11 for providing the protective device 10 with uniform rigidity. It is also preferred that the stiffener 28 have a cross-sectional configuration which complements or corresponds to the pertinent portion of the tubular cross section of the housing 11. In the present embodiment, it is preferred that the stiffener 28 be of generally rectangular cross section. However, it is understood by those skilled in the art that the stiffener 28 can be configured in any cross-sectional shape so long as it generally complements the portion of the interior 14 of the housing 11 without departing from the scope and spirit of the invention.

In use, the protective device 10 is positioned within the concrete formwork 26, as shown in FIG. 2. The concrete formwork 26 includes an area for receiving the first poured concrete 24, as is understood by those skilled in the art. The protective device 10 is positioned within the concrete formwork 26 such that the seam 30 of the housing 11 is in facing relationship with the formwork 26 with the second portion 20*b* of the steel reinforcement bars 20 extending into the formwork area.

In the first preferred embodiment, the protective device 10 is secured to the formwork 26 by nails or tacks, as is understood by those skilled in the art. However, it is also understood by those skilled in the art that the protective device 10 can be secured to the formwork 26 in any suitable manner, such as with adhesive or screws.

The formwork area is filled with concrete which is allowed to solidify about the protective device 10 to form a first poured concrete structure 24. The formwork 26 is removed from the solidified concrete to provide access to the protective device 10. The adhesive tape 16 is cut or severed at the seam 30 with a knife or other similar tool. This allows the sheet of material 12 to be partially unfolded so that the interior 14 of the housing 11 and the first portion 20*a* of the steel reinforcement bars 20 can be accessed, as shown in FIG. 3.

With the second end portion 12*b* disengaged from the first end portion 12*a* of the sheet of material 12, the stiffener 28 is removed and the first portion 20*a* of each of the steel reinforcement bars 20 is bent to a generally perpendicular position with respect to the first poured concrete structure 24, as shown in FIG. 3. The sheet of material 12 is removed from the solidified concrete by sliding the apertures 22 over the first portion 20*a* of the steel reinforcement bars 20. Thus, a groove is formed in the first poured concrete structure and the steel reinforcement bars 20 are placed in position for receiving a second poured concrete structure (not shown). New formwork (not shown) is positioned about the first portion 20*a* of the steel reinforcement bars 20 for pouring a second concrete structure thereabout to form a concrete joint structure.

Figure 4:
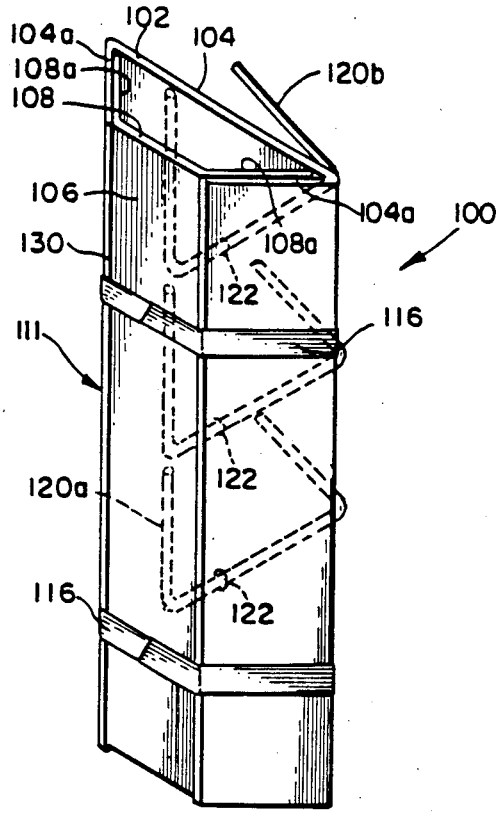
FIG. 4 is a perspective view of a device for housing steel reinforcements in accordance with a second preferred embodiment of the invention.
Figure 5:
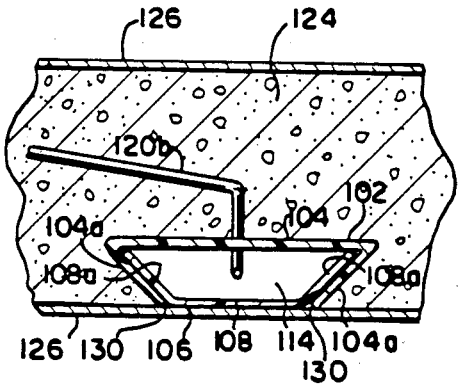
FIG. 5 is a cross-sectional view of the device of FIG. 4 positioned within a first poured concrete structure.
Figure 6:
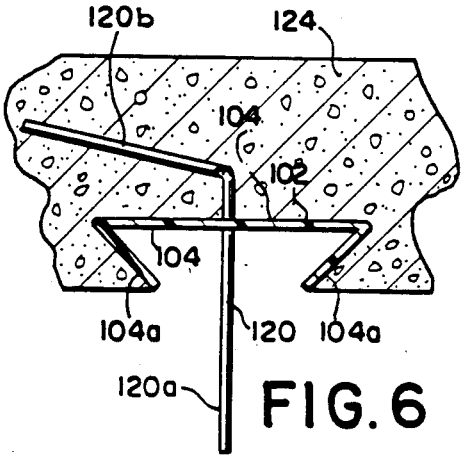
FIG. 6 is a cross-sectional view of the device of FIG. 4 in the open position for bending the steel reinforcement bars to horizontal.

Referring now to FIGS. 4–6, there is shown a second preferred embodiment of a protective device, generally designated 100 for housing a steel reinforcement in an area where joints are made between first and subsequently poured concrete structures.

As shown in FIGS. 4 and 5, the protective device 100 includes a metallic portion 102 for being permanently imbedded in the first poured concrete structure 124. The metallic portion 102 includes a base 104 with at least one aperture 122 therethrough for receiving a steel reinforcement bar 120, as discussed above. The base includes a pair of inwardly depending sidewalls 104*a* extending therefrom at a first predetermined angle.

In the second preferred embodiment, the metallic portion 102 is preferably constructed of sheet metal having a thickness of approximately 22 gauge. Preferably, the sheet metal is constructed of a steel alloy. However, it is understood by those skilled in the art that the metallic portion 102 can be constructed of other materials, such as brass.

In the second preferred embodiment, the metallic portion 102 is generally trapezoid-like in cross section. However, it is understood by those skilled in the art, that the metallic portion 102 can be formed in other configurations, such as generally U-shaped in cross section.

As shown in FIGS. 4 and 5, the protective device 10 includes a polymeric cap portion 106 having a top section 108 positioned opposite the base portion 104. The top section 108 preferably includes a pair of outwardly depending sidewalls 108*a* extending therefrom at a second predetermined angle. The sidewalls 108*a* are preferably shaped and positioned to generally complement the inwardly depending sidewalls 104*a* of the metallic portion 102. The polymeric cap portion 106 is positioned generally within the metallic portion 102 such that the inwardly depending sidewalls 104*a* overlap the outwardly depending sidewalls 108*a* in facing relationship. Thus, the metallic portion 102 and the polymeric cap portion 106 form a generally tubular housing 111 defining an interior area 114 for receiving the steel reinforcement bars 120.

In the second preferred embodiment, it is preferred that the metallic portion 102 and polymeric cap portion 106 form a generally tubular housing of trapezoid-like cross section. However, it is understood by those skilled in the art, that the metallic portion 102 and polymeric cap portion 106 can cooperate to form other generally tubular configurations, such as square or rectangular in cross section.

In the second preferred embodiment, polymeric cap portion 106 is preferably corrugated to provide the cap portion with structural integrity without increasing the overall weight of the protective device 100. However, it is appreciated by those of ordinary skill in the art that the polymeric cap portion 106 can be constructed of other configurations such as a regular flat sheet of material. Specifically, it is preferred that the polymeric cap portion 104 be constructed of the same material as the sheet of material 12 in the first preferred embodiment, described above.

Referring now to FIG. 4, the polymeric cap portion sidewalls 108*a* are held in facing relation with the base portion sidewalls 104*a* by securing means. The securing means is removable for allowing the polymeric cap portion 106 to be readily removed from the metallic portion 102 after the metallic portion 102 is imbedded within the first poured concrete structure 124.

In the second preferred embodiment, the securing means preferably comprises strips of adhesive tape 116 wrapped around the outer periphery of the polymeric cap portion 106 and the metallic portion 102. This allows access to the interior region 114 of the housing by cutting the adhesive tape 116 at the seams 130 and removing the polymeric cap portion 106. The polymeric cap portion 106 is removed from the metallic portion 102 by pulling the cap portion 106 away from the first poured concrete structure 124 in a direction perpendicular thereto. Since the cap portion 106 is pliable, the side walls 108*a* deflect towards each other around the side walls 104*a*.

The protective device 100 also includes a plurality of steel reinforcement bars 120 having a first portion 120*a* and a second portion 120*b* similar to that discussed above in connection with the first preferred embodiment. Consequently, further description of the steel reinforcement bars 120 is not necessary and is not limiting.

It is understood by those skilled in the art, that a stiffener (not shown), as described in the first preferred embodiment, may be included between the metallic and polymeric cap portions 102, 106 for increasing the structural integrity of the protective device 100.

In use, the protective device 100 is installed generally identically to the protective device 10, as is described above and is understood by those skilled in the art. However, when the cap portion 106 is removed to expose the bars 120 as shown in FIG. 6, the metallic portion 102 remains imbedded in the first poured concrete structure 124. Further description of the method of using the protective device 100 is not necessary nor limiting in view of the detailed description above concerning the first preferred embodiment.

From the foregoing description, it can be seen that the present invention comprises a protective device for housing a steel reinforcement in an area where joints are made between first and subsequently poured concrete structures. It is recognized by those skilled in the art that changes may be made to the above-described embodiments of the invention without departing from the broad inventive concept thereof. It is understood, therefore, that this invention is not limited to the particular embodiments disclosed, but is intended to cover all modifications which are within the scope and spirit of the invention as defined by the appended claims.

I claim:

1. A device for housing a steel reinforcement in an area where joints are made between first and subsequently poured concrete structures, said device comprising:

a single sheet of material having a first end portion and an opposed second end portion, said single sheet of material being folded such that said first end portion and said second end portion are in facing overlapping engagement to thereby form a housing of generally tubular cross section;

securing means for holding said single sheet of material in said folded position with said first and second end portions in facing overlapping engagement for preventing liquefied concrete from entering the housing and for allowing quick access to the interior of said housing by severing said securing means and unfolding said single sheet of material; and at least one steel reinforcement bar having a first portion thereof positioned within said housing for being embedded in said subsequently poured concrete structure and a second portion thereof extending out of said housing through an aperture in said single sheet of material for being embedded in said first poured concrete structure, said at least one steel reinforcement bar being completely supported within said housing by said single sheet of material.

2. The device for housing a steel reinforcement as recited in claim 1 wherein said single sheet of material is corrugated.

3. The device for housing a steel reinforcement as recited in claim 2 wherein said sheet of material is a polymer.

4. The device for housing a steel reinforcement as recited in claim 1 wherein said generally tubular housing is generally rectangular in cross section.

5. The device for housing a steel reinforcement as recited in claim 1 further including a stiffner positioned within said housing for increasing the rigidity of said housing.

6. A device for housing a steel reinforcement in an area where joints are made between first and subsequently poured concrete structures, said device comprising:

a sheet of corrugated polymeric material having a first end portion and an opposed second end portion, said sheet of material being folded such that said first end portion and said second end portion overlap to form a generally tubular housing;

tape wrapped around said generally tubular housing for holding said sheet of material in said folded position and allowing quick access to the interior of said housing by cutting said tape and unfolding said sheet of material; and at least one steel reinforcement bar having a first portion thereof positioned within said housing for being embedded in said subsequently poured concrete structure and a second portion thereof extending out of said housing through an aperture in said housing for being embedded in said first concrete structure.

7. A method of forming a joint of a concrete structure between first and subsequently poured concrete structures comprising the steps of:

providing a sheet of material having a first end portion and an opposed second end portion, said sheet of material being folded such that said first end portion and said second end portion are in engagement to form a housing of generally tubular cross section having a seam between said first and second end portions;

wrapping tape around a portion of said generally tubular housing for holding said sheet of material in said folded position;

providing at least one steel reinforcement bar having a first portion thereof positioned within said housing for being imbedded in said subsequently poured concrete structure and a second portion thereof extending out of said housing through an aperture in said housing for being imbedded in said first poured concrete structure;

positioning said housing within a concrete formwork having an area for receiving said first poured concrete such that said seam of said housing is in facing relationship with said formwork and said second portion of said steel reinforcement bar extends inwardly into said formwork area;

filling said formwork area with concrete and allowing the concrete to solidify to form a first poured concrete structure;

removing said formwork from said solidified concrete to access said housing;

cutting said tape at said seam and partially unfolding said housing to provide access to the interior thereof and said first portion of said steel reinforcement bar;

bending said first portion of said steel reinforcement bar to a generally perpendicular position with respect to said first poured concrete structure;

removing said housing from said first poured concrete structure over said first portion of said steel reinforcement bar;

and pouring a second concrete structure about said first portion of said steel reinforcement bar to thereby form a concrete joint structure.

8. A device for housing a steel reinforcement in an area where joints are made between first and subsequently poured concrete structures, said device comprising:

a metallic portion for being embedded in said first poured concrete structure having a base with at least one aperture therein for receiving a steel reinforcement bar therethrough, said base having a pair of inwardly depending sidewalls extending therefrom;

a polymeric cap portion having a top section positioned opposite said base portion, said top section having a pair of outwardly depending sidewalls extending therefrom, shaped and positioned to complement said inwardly depending sidewalls such that said inwardly depending sidewalls overlap said outwardly depending sidewalls in facing relationship wherein said metallic portion and cap portion form a generally tubular housing defining an interior area for receiving steel reinforcement bars;

securing means for holding said polymeric cap portion sidewalls in facing relation with said base portion sidewalls, said securing means being removable for allowing said polymeric cap portion to be readily removed from said metallic portion after said metallic portion is embedded within said first poured concrete structure; and at least one steel reinforcement bar having a first portion thereof positioned between said metallic base portion and said polymeric cap portion for being embedded in said subsequently formed concrete structure and a second portion thereof extending out of said housing through said aperture in said metallic portion base for being embedded in said first concrete structure.

9. The device for housing steel reinforcements as recited in claim 8 wherein said polymeric cap portion is corrugated.

10. The device for housing steel reinforcements as recited in claim 9 wherein said securing means comprises tape wrapped around a portion of the outer periphery of said polymeric cap portion and said metallic portion for allowing quick access to the interior region of said housing by cutting said tape and removing said polymeric cap portion.

11. A devise for housing a steel reinforcement in an area where joints are made between first and subsequently poured concrete structures, said device comprising:

a sheet of material having a first end portion and an opposed second end portion, said sheet of material being folded such that said first end portion and said second end portion are in engagement to thereby form a housing of generally tubular cross-section;

tape wrapped around a portion of said generally tubular housing for holding said sheet of material in said folded position and for allowing quick access to the interior of said housing by cutting said tape and unfolding said sheet of material; and at least one steel reinforcement bar having a first portion thereof positioned within said housing for being imbedded in said subsequently poured concrete structure and a second portion thereof extending out of said housing through an aperture in said housing for being imbedded in said first poured concrete structure.

* * * * *